US011225043B2

(12) United States Patent
Schalk et al.

(10) Patent No.: US 11,225,043 B2
(45) Date of Patent: Jan. 18, 2022

(54) APPARATUS FOR THE MANUAL OR MACHINE-MADE PRODUCTION OF A TUBE-LIKE PACKAGING MATERIAL AND PACKING STATION

(71) Applicant: Sprick GmbH Bielefelder Papier- und Wellpappenwerke & Co., Bielefeld (DE)

(72) Inventors: Bastian Schalk, Detmold (DE); Marco Schwarberg, Melle (DE); Vitali Krebs, Ahlen (DE)

(73) Assignee: Sprick GmbH Bielefelder Papier—und Wellpappenwerke & Co., Bielefeld (DE)

( * ) Notice: Subject to any disclaimer, the term of this patent is extended or adjusted under 35 U.S.C. 154(b) by 40 days.

(21) Appl. No.: 16/631,061

(22) PCT Filed: Jul. 12, 2018

(86) PCT No.: PCT/EP2018/068972
§ 371 (c)(1),
(2) Date: Jan. 14, 2020

(87) PCT Pub. No.: WO2019/012053
PCT Pub. Date: Jan. 17, 2019

(65) Prior Publication Data

US 2020/0147918 A1 May 14, 2020

(30) Foreign Application Priority Data

Jul. 14, 2017 (DE) ..... 10 2017 115 918.5

(51) Int. Cl.
*B31B 50/00* (2017.01)
*B31B 50/38* (2017.01)
(Continued)

(52) U.S. Cl.
CPC ..... *B31D 5/0043* (2013.01); *B31B 50/006* (2017.08); *B31B 50/38* (2017.08);
(Continued)

(58) Field of Classification Search
CPC ..... B65H 19/12; B65H 2301/4172; B65H 2801/63; B65H 16/021; B65H 35/04;
(Continued)

(56) References Cited

U.S. PATENT DOCUMENTS 2,508,566 A * 5/1950 Dunton ..... B65H 16/021 242/559.3
3,484,052 A * 12/1969 Clarke ..... A47K 10/3836 242/560.2
(Continued)

FOREIGN PATENT DOCUMENTS

CA 2511312 A1 7/2004
DE 69803427 T2 8/2002
(Continued)

OTHER PUBLICATIONS

International Search Report for Application No. PCT/EP2018/068972, dated Nov. 21, 2018.
(Continued)

*Primary Examiner* — Thomas M Wittenschlaeger
(74) *Attorney, Agent, or Firm* — Schiff Hardin LLP

(57) ABSTRACT

An apparatus for the manual/automatic production of a tube-like packaging material can include a guiding chute with an opening for ejecting the packaging material from a roll arranged in the ejection position, wherein the guiding chute has an inner contour narrowing towards an opening in an ejection direction, a primary seating for at least partly circumferentially gripping the first roll and for holding the first roll in the ejection position, and at least one secondary seating for receiving of at least a second roll for reloading
(Continued)

Figure 1:
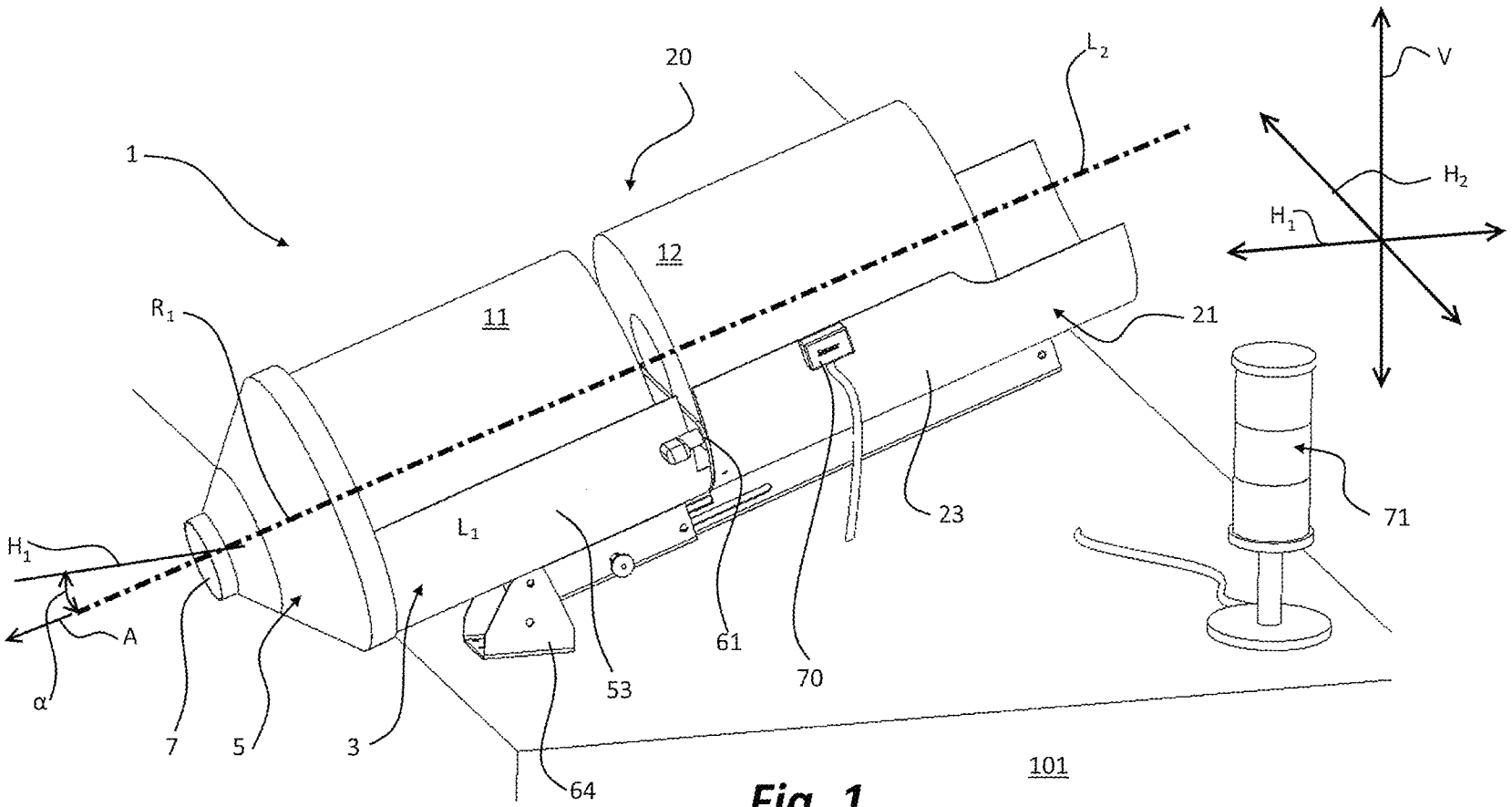

the apparatus, wherein the secondary seating is movable with a second roll between a passive position in which the second roll is outside an ejection position and an active position in which the second roll is arranged in the ejection position or is displaceable from the secondary seating into the primary seating under (e.g. exclusively under) the impact of gravity.

18 Claims, 7 Drawing Sheets

(51) Int. Cl.
*B31D 5/00* (2017.01)
*B65H 16/02* (2006.01)
*B65H 35/04* (2006.01)

(52) U.S. Cl.
CPC ..... *B31D 5/0086* (2013.01); *B65H 16/021* (2013.01); *B65H 35/04* (2013.01); *B65H 2801/81* (2013.01)

(58) Field of Classification Search
CPC ..... B65H 2405/44; B65H 2301/41745; B65H 2301/4174; B65H 2801/81; B65B 41/12; B31D 5/0043; B31D 5/0086; B31D 2205/0082; B31D 2205/0005; B31D 2205/0029; B31B 50/006; B31B 50/38; A47K 10/38; A47K 2010/3253; B65G 11/12; B65G 39/00; B65G 39/12; B65G 41/002; B65G 65/02
See application file for complete search history.

(56) References Cited

U.S. PATENT DOCUMENTS 3,865,295 A * 2/1975 Okamura ..... A47K 10/38 225/47
4,294,389 A * 10/1981 Falk ..... A47K 10/3827 225/34
4,314,679 A * 2/1982 Paul ..... A47K 10/3827 242/560.3
4,410,221 A * 10/1983 Vallis ..... A47K 10/3827 312/34.22
4,589,811 A * 5/1986 Riccardo ..... B65H 19/123 193/35 R
4,840,321 A * 6/1989 Focke ..... B65H 16/04 242/422.3
5,203,761 A * 4/1993 Reichental ..... B26D 1/185 493/346
5,219,127 A * 6/1993 Boldrini ..... B65H 19/123 242/559.1
5,449,127 A * 9/1995 Davis ..... A47K 10/38 242/560
5,697,577 A * 12/1997 Ogden ..... A47K 10/38 242/596.8
6,089,499 A * 7/2000 Robinson ..... A47K 10/3818 242/560
6,217,501 B1 * 4/2001 Simmons, Jr ..... B31D 5/0047 493/12
6,481,665 B2 * 11/2002 Walker ..... B65H 19/126 242/557
6,679,409 B2 * 1/2004 Petterson ..... A47K 10/3827 225/34
6,918,489 B2 7/2005 Harding et al.
7,022,060 B2 * 4/2006 Toth ..... B31D 5/0047 493/464
7,185,843 B1 * 3/2007 Li ..... A47K 10/40 242/560
8,696,345 B2 * 4/2014 Sprick-Schutte .... B31D 5/0047 425/403.1
9,321,235 B2 * 4/2016 Cheich ..... B31D 5/0043
9,914,279 B2 * 3/2018 Van der Kaap .... B65H 19/1857
9,937,682 B2 * 4/2018 Schmid ..... B65H 16/005
2007/0117703 A1 5/2007 Cavaliere et al.
2007/0287623 A1 * 12/2007 Carlson ..... B31D 5/0047 493/464
2012/0053033 A1 3/2012 Sprick-Schuett et al.
2012/0165172 A1 * 6/2012 Wetsch ..... B65H 35/008 493/352
2014/0274647 A1 * 9/2014 Wetsch ..... B31D 5/0043 493/464
2015/0119224 A1 * 4/2015 Orsini ..... B31D 5/0043 493/464
2015/0273784 A1 * 10/2015 Schmid ..... B31D 5/0039 242/562
2015/0360434 A1 * 12/2015 Van der Kaap ..... B65H 19/12 108/50.11

FOREIGN PATENT DOCUMENTS

DE 102009015855 A1 10/2010
DE 202012009025 U1 12/2012
DE 102012018867 A1 3/2014
DE 202016002839 U1 6/2016

OTHER PUBLICATIONS

Notification Concerning Transmittal of International Preliminary Report on Patentability and Notification of Transmittal of Translation of the International Preliminary Report on Patentability dated Jan. 23, 2020, for International application No. PCT/EP2018/068972 (English translation included).

* cited by examiner

APPARATUS FOR THE MANUAL OR MACHINE-MADE PRODUCTION OF A TUBE-LIKE PACKAGING MATERIAL AND PACKING STATION

CROSS REFERENCE TO RELATED APPLICATIONS

This patent application is a U.S. National Stage Application of PCT/EP2018/068972, filed Jul. 12, 2018, which claims priority to German Patent Application No. 102017115918.5, filed Jul. 14, 2017, each of which is incorporated herein by reference in its entirety.

BACKGROUND

Field

The disclosure relates to an apparatus for the production of a tube-like packaging material from a paper strip. The production of the packaging material can take place purely manually or machine-supported. The disclosure also relates to a packing station with an apparatus according to the disclosure.

Related Art

An apparatus for the manual production of a helical-shaped packaging material is known from DE 20 2012 009 025 U1. The apparatus comprises a seating for circumferentially gripping a wound roll of fibrous material defining an axial direction and forming an inner side from which the fibrous material strip is stripped for forming the packaging material. A fixture for the front side of the fibrous material strip roll is following up the seating in the axial direction, the inner side of the fixture narrowing towards the output opening in order to guide the stripped fibrous material strip to the output at the opening. The fibrous material strip is manually pulled out from the output opening as a spiral tube-shaped packaging material, whereby the forming of the packaging material takes place by pulling out. The manual product apparatus for the spiral-shaped packaging material is employable practically maintenance-free and fail safe. When so many packages are packed with packaging material by means of the manual packaging material product apparatus that the paper strip roll is empty, the packing staff can simply provide a new roll.

An apparatus for the automatic production of a spiral tube-like packaging material is described in DE 10 2009 015 855 A1. For the operation, a packaging material seating of the apparatus is provided with a material strip wound to a roll. The material strip roll is unwound or stripped from the inner side and is fed through a feed chute being formed cone-shaped at the inner side to a motor-driven forming teeth wheel pair of the machine forming unit. The motor-driven forming teeth wheels are gripping the packaging material in order to feed the same by the packaging material seating in the direction of the output and the forming teeth wheels are forming it in such a way that a tube-like packaging material being strengthened along its length axis by embossing is formed from a flat strip material of the roll which is preformed tube-like in the feeding chute. The filling material arrives at an output mouth piece of the housing carrier defining the output opening for ejecting the packaging material. Thanks to the motorization of the packaging material production apparatus, the same can provide in shorter times larger amounts of packaging material compared to the manual packaging material production apparatus described above. An automatic packaging material production apparatus being equipped with a respective control electronics is furthermore able to produce predefined packaging material units from a predefined amount of original material according to predefined control processes or program sequences. By this, the amount of provided packaging material and the amount of consumed raw material can be optimized and controlled.

It can be calculated for example after which number of packages possibly being filled with a known or appreciable number of packaging materials a new paper strip roll is needed by the automatic packaging material product apparatus.

A different automatic product apparatus for packaging material is described in US 2007/0117703 A1. A roll wound on a spool at this apparatus serves as paper supply, the roll being unwound at the outer side. When a particularly large paper strip supply is desired, a roll with larger diameter can be chosen. It is thereby unfavorable that larger rolls come along with a greater weight by which the reloading is very demanding. In addition, the problem during operation, particularly during a fast production of large amounts of packaging material, is that the supply roll is rotating with great velocity. Because of the turning supply roll, paper jam and/or ripping off of the paper strip can occur especially during ramp up or during breaking of the automatic packaging material forming unit. When such an error is occurring, its trouble shooting is connected to a greater, undesired time effort.

An automatic packaging material apparatus and a facility with packing stations comprising the automatic packaging material production apparatuses discloses U.S. Pat. No. 6,981,489 B2. The packing stations (for example shown in FIG. 18) are equipped with packaging material production apparatuses being loaded from a large supply depot with Leporello-folded or zig-zag-folded paper strip stacks. A shelf space is provided at the front side of the packing station on which the packing staff can fill packages with shipping goods and packaging material. Packaging material can be dispensed from the automatic production apparatus for filling the packaging on the shelf space. The automatic production apparatus is provided by a stack supply being located behind the production apparatus. To always provide sufficient packaging material to the packaging staff at the shelf space, the staff constantly moving on a plank behind the production apparatus fills the production apparatus of several packing stations. The refilling takes place by means of single Leporello paper strip stacks whose paper strip sections are connected to each other by adhesive tape so that the automatic packaging production apparatus can directly process the next Leporello stack without ceasing after one Leporello stack is consumed. It was found to be unrealistic to assume a perfect, error-free operation and error-free material. If paper jam a rip off in the supply material strip or a missing or not functioning connection to a following Leporello stack occurs at such a system, an automatic packaging material production apparatus runs empty and has to be refilled with great time effort. The effort of refilling is, among others, related to the complexity of the paper strip feed of the packaging material production apparatus and on the other hand by the separated construction of the facilities. Furthermore, the great space effort for the stock keeping, the plank, etc. is undesired.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 2B:
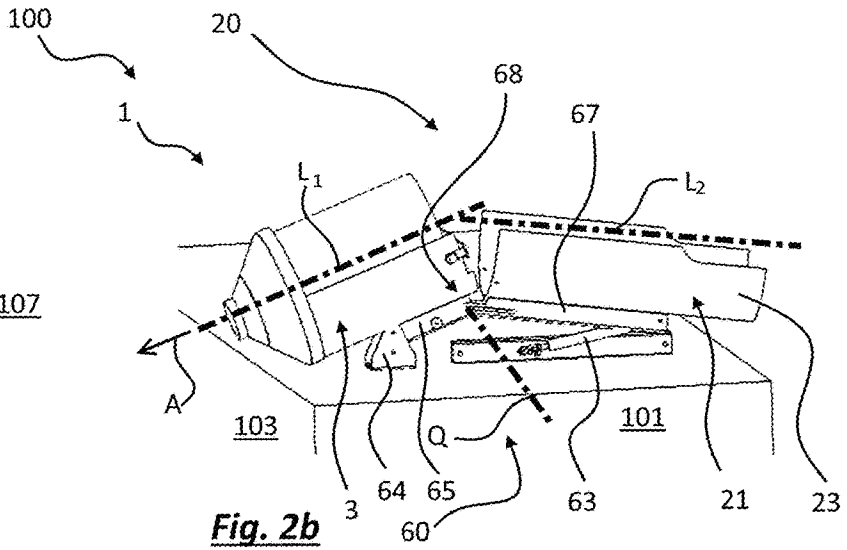
Figure 2A:
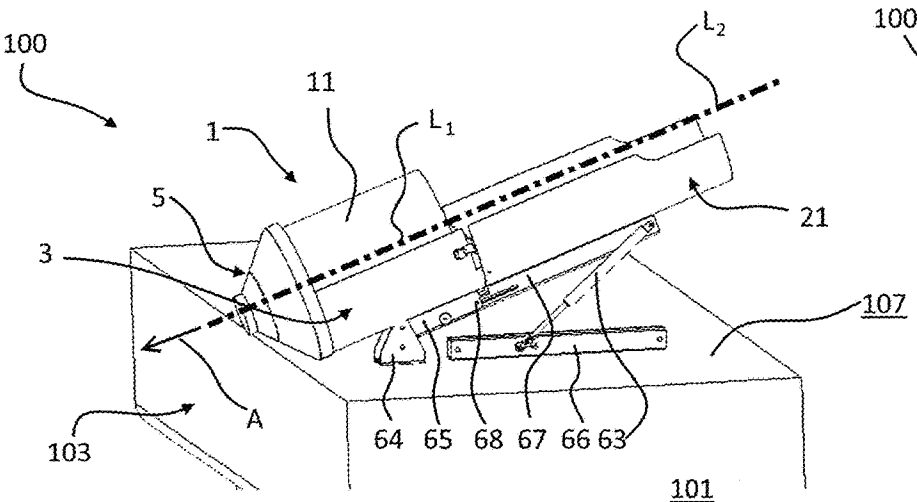
Figure 2D:
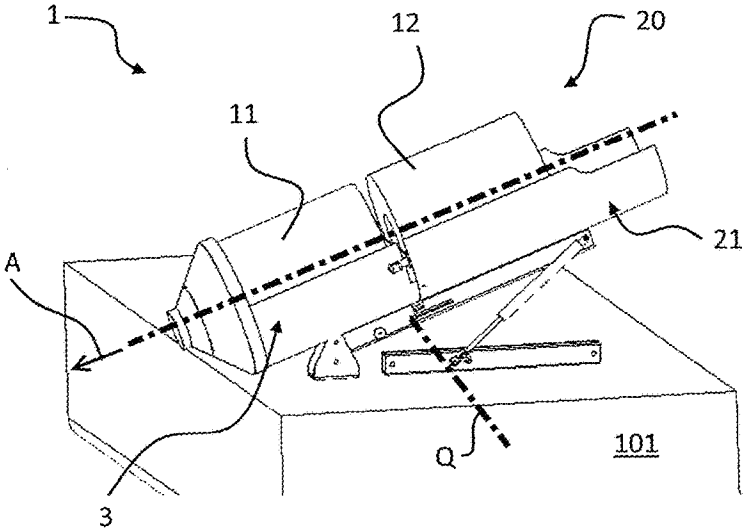
Figure 2C:
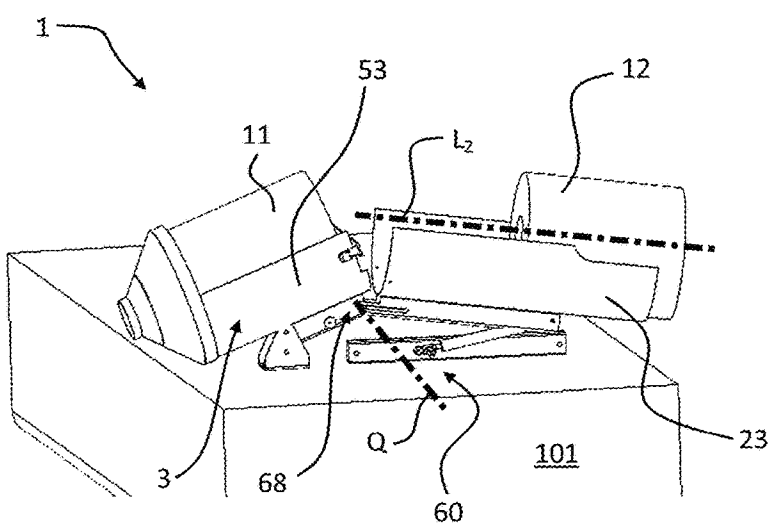
Figure 3B:
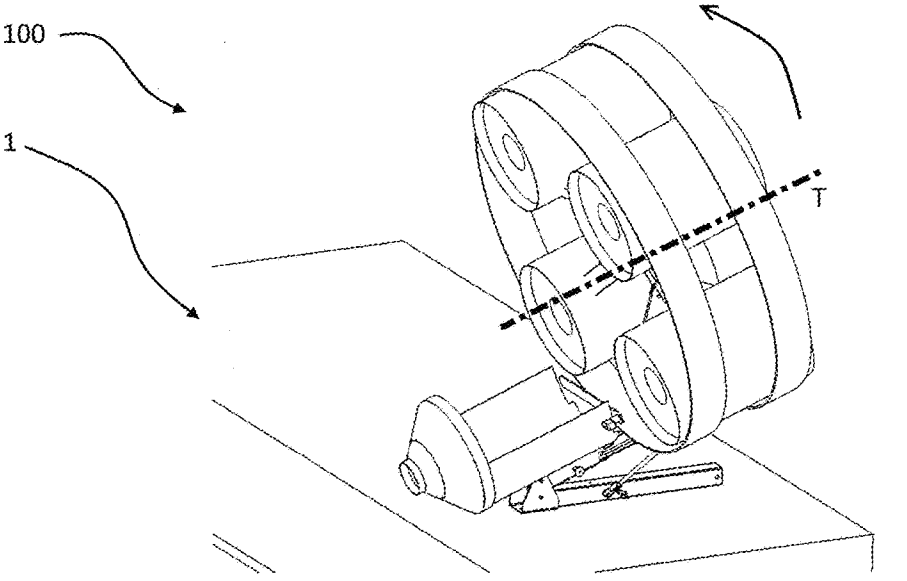
Figure 3D:
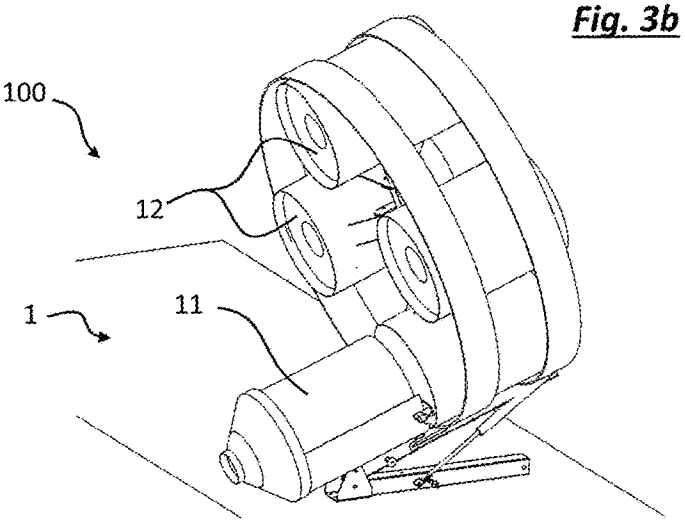
Figure 3A:
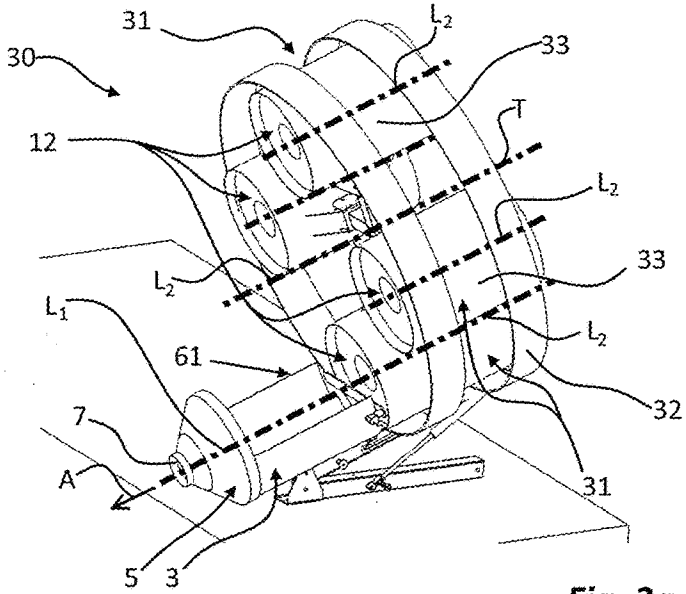
Figure 3C:
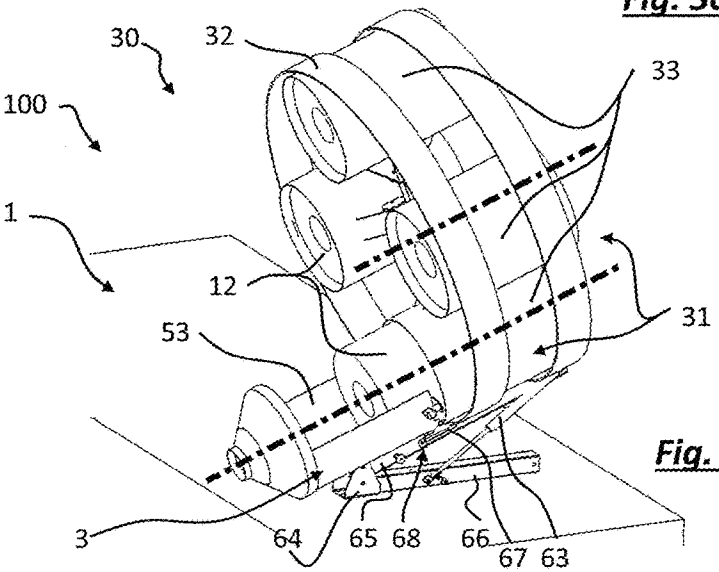
Figure 4A:
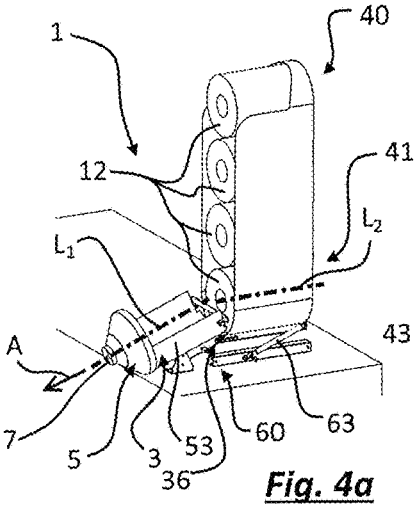
Figure 4B:
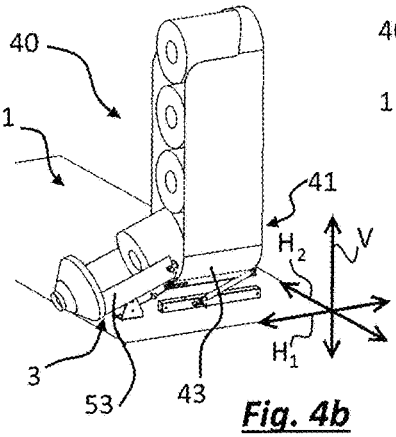
Figure 4C:
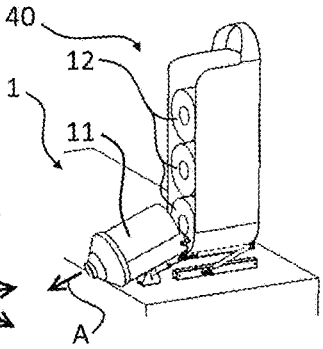
Figure 4D:
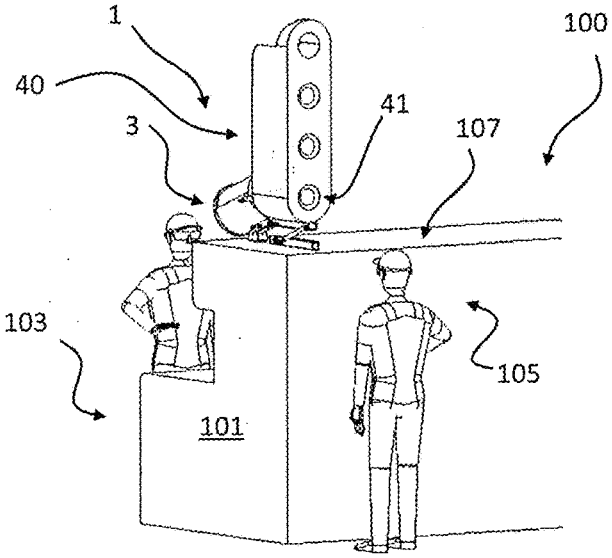
Figure 4E:
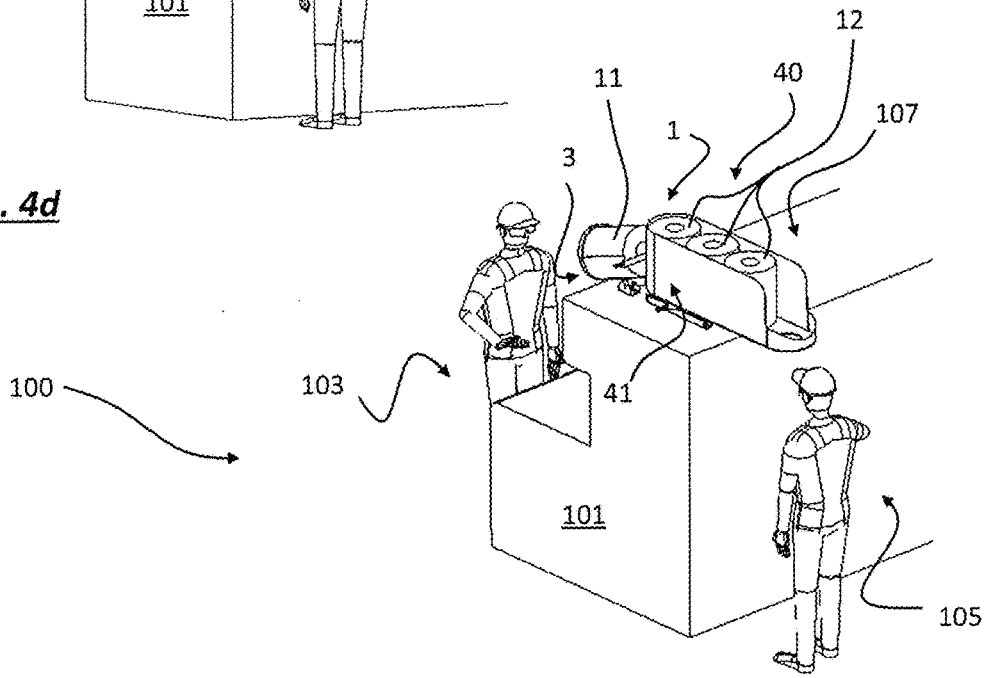
Figure 5A:
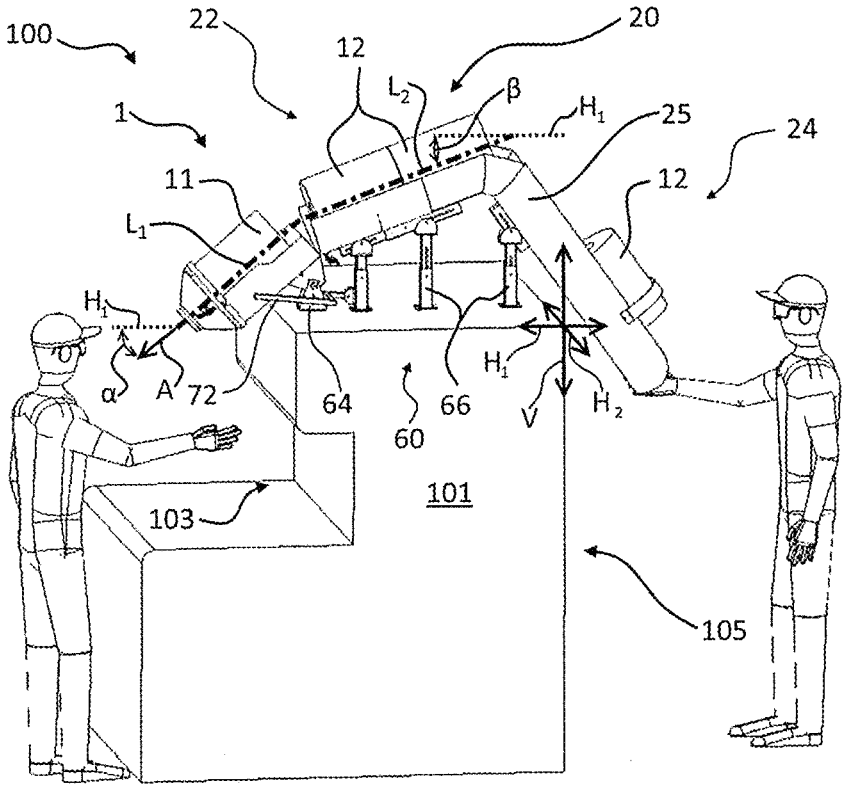
Figure 5B:
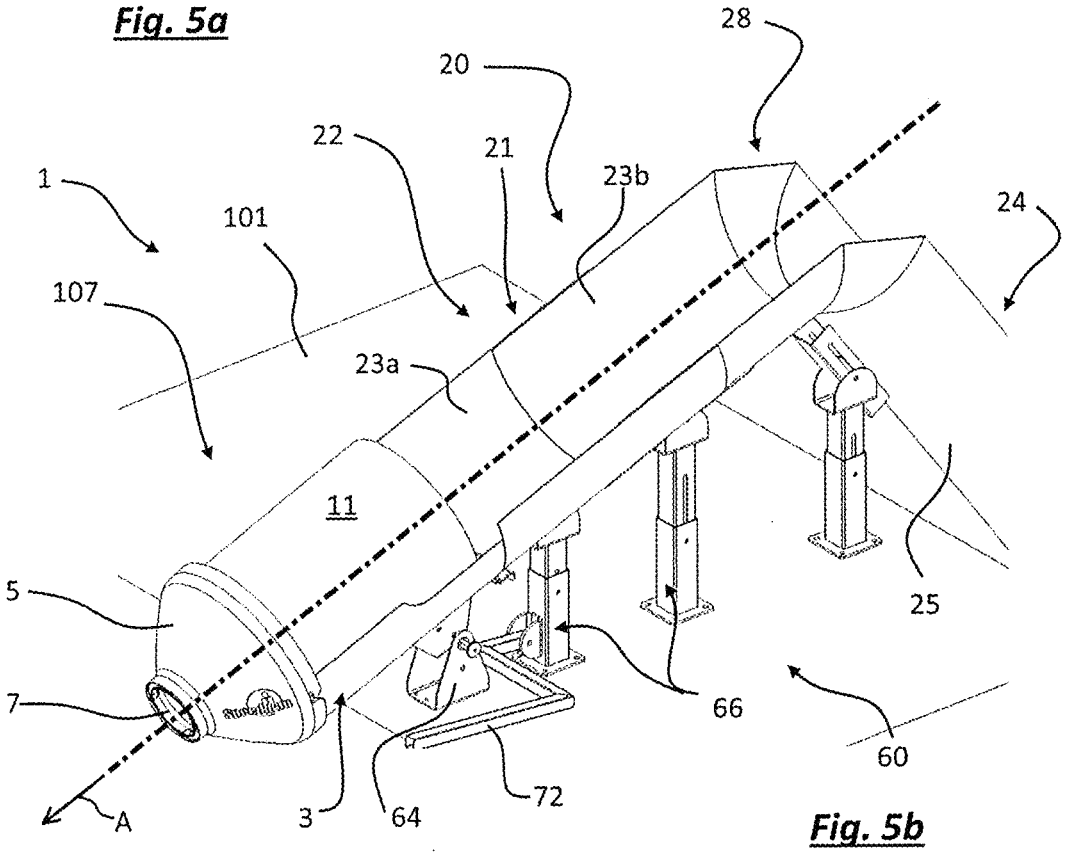
Figure 5C:
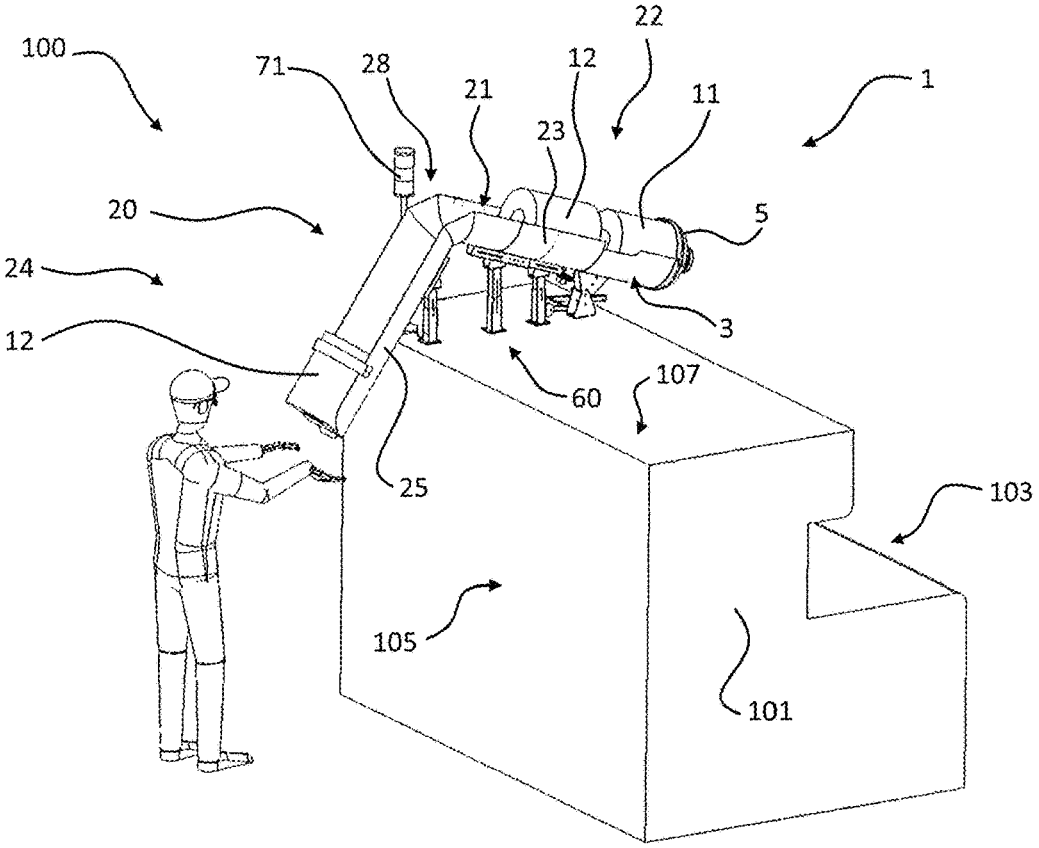
Figure 5D:
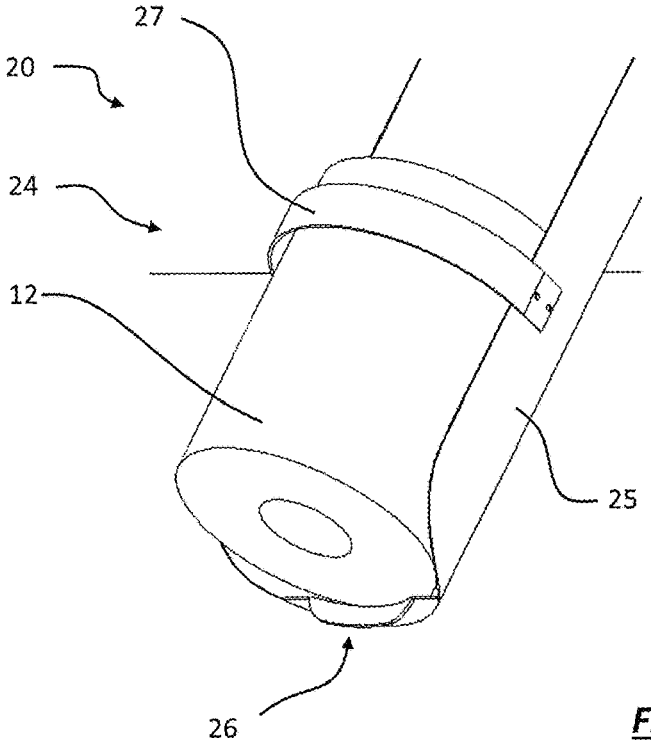
Figure 5G:
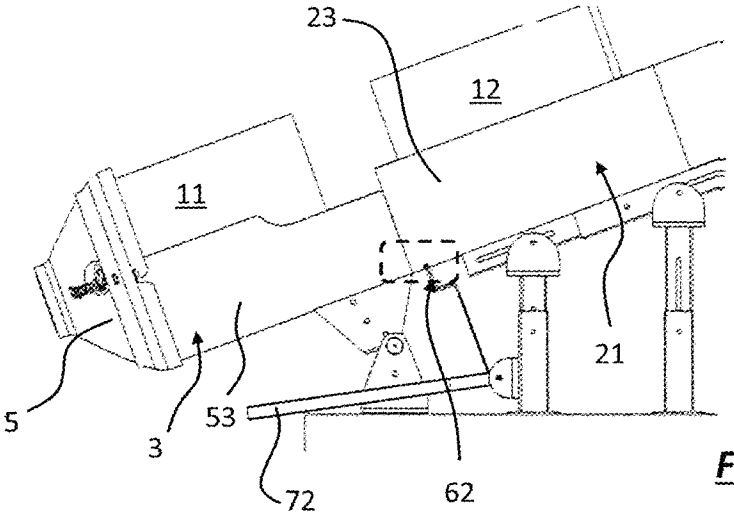
Figure 5H:
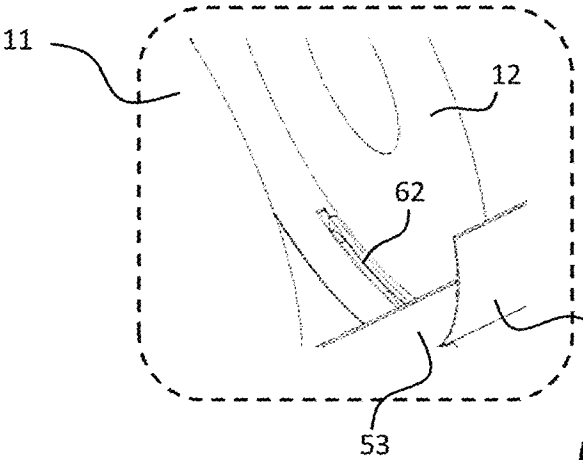
Figure 5E:
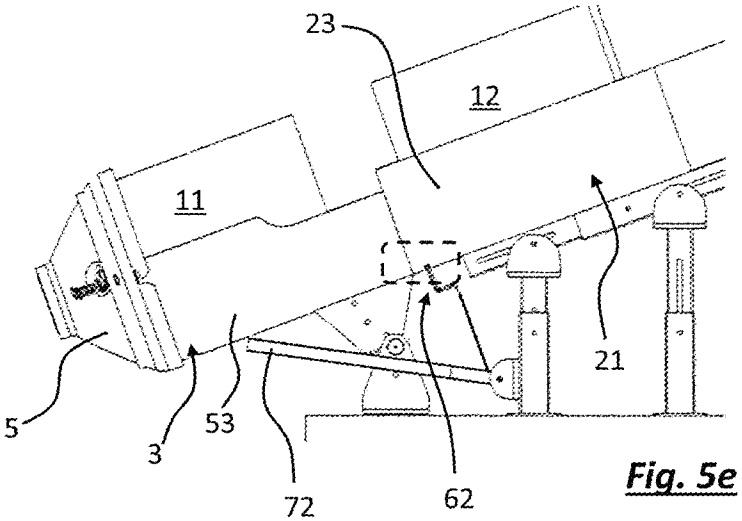
Figure 5F:
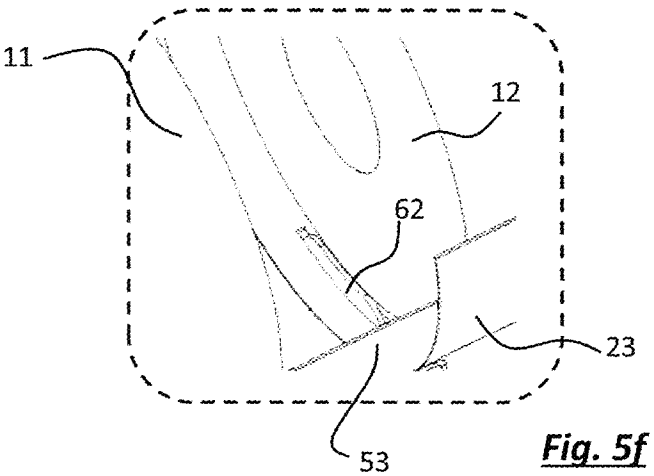

FIG. 1 an exemplary embodiment of the production apparatus according to the disclosure;

FIG. 2A an exemplary embodiment of the apparatus for the manual production of the packaging material according to the disclosure;

FIG. 2B an apparatus according to FIG. 2A with a secondary seating being lowered and displaced backwards in a filling station;

FIG. 2C an apparatus according to FIG. 2A in the position according to FIG. 2B, wherein the secondary seating is filled with another roll;

FIG. 2D an apparatus according to FIG. 2A with filled secondary seating in an active reloading position, wherein a bar is in the retainer position between the secondary seating and the primary seating;

FIG. 3A an exemplary embodiment of an apparatus for the manual production of a tube-like packaging material according to the disclosure with a secondary seating being formed as a drum magazine;

FIG. 3B an apparatus according to FIG. 3A, being positioned in a position displaced to the seating longitudinal axis of the primary seating;

FIG. 3C an apparatus according to FIG. 3A whose secondary seatings are in an active reloading position, wherein the paper strip roll slides from a secondary seating into the primary seating;

FIG. 3D an apparatus according to FIG. 3A with a roll in the ejection position;

FIG. 4A an exemplary embodiment of the apparatus for the manual or automatic production of a tube-like packaging material according to the disclosure with a secondary seating formed as rod magazine;

FIG. 4B an apparatus according to FIG. 4A in a state in which the second roll is displaced in the primary seating;

FIG. 4C an apparatus according to FIG. 4A with a first roll arranged in the ejection position and three second rolls lying on top of each other in a box magazine in the vertical direction;

FIG. 4D a packing station with the apparatus according to FIG. 4A in the state according to FIG. 4C;

FIG. 4E an apparatus according to FIG. 4A in a packing station, whereas packing staff can gather packaging material from the apparatus from a roll in the primary seating at the front side of the packing station and the box magazine is in a filling position tilted backwards, on which filling staff standing at the rear side of the frame can load the box magazine with fresh paper material strip rolls;

FIG. 5A a perspective side view of the packing station with a production apparatus according to the disclosure according to an exemplary embodiment;

FIG. 5B a production apparatus according to FIG. 5A;

FIG. 5C a perspective rear view of the packing station according to FIG. 5A;

FIG. 5D a detailed section of a reloading section of the apparatus according to FIG. 5A or 5C, respectively;

FIG. 5E and FIG. 5F detailed views of the apparatus according to FIG. 5A with a retainer means in a retainer position; and FIG. 5G and FIG. 5H detailed views of the apparatus according to FIG. 5A with a retainer means in its passage position.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the disclosure is to provide an apparatus for the manual or automatic production of a packaging material or a packing station with such an apparatus, being equipped with a great reliability and availability with, at the same time, low tendency of maintenance or errors and which can provide large amounts of packaging material fast from a paper strip material.

According to that, an apparatus for the manual or automatic production of a tube-like packaging material from a paper strip wound to a roll is provided according to exemplary embodiments. A tube-like packaging material can also be denoted as a three-dimensional packaging material. A three-dimensional packaging material can be brought from a two-dimensional, plane, strip-shaped original material, usually a paper strip roll, into a three-dimensional structure having at least a crumple hollow space for providing damping and cushioning functions. Such a crumple hollow space can extend in the longitudinal direction of the packaging material. It may also therefore be denoted as tube-like packaging material. A tube-like packaging material can for example, as described in DE 10 2012 018 867 A1, be formed with an imprint extending in the longitudinal direction of the packaging material, which is stabilizing the packaging material. An imprint, as described in DE 10 2012 018 867 A1 in detail, approximately in the transverse width of the packaging material, the packaging material has two crumple hollow spaces in transverse direction (right and left) adjacent to the imprint strips. The tube-like packaging material can be provided cushion-like at a front-sided or rear-sided end with a stabilization, for example an imprint or punching, extending over a majority or the entire transverse width in order to protect single packaging material units in the shape of a cushion against unfolding starting from the longitudinal end sides. Such a cushion-like packaging material unit can be provided with a longitudinal imprint or be free of longitudinal imprints. The entire content matter of DE 10 2012 018 867 A1 is included by reference. A tube-like packaging material with three-dimensional shape can also be embodied without stabilizing imprints (in the longitudinal or transverse direction), as laid out for example in DE 20 2012 009 025 U1, where a spiral-shaped tube is formed by the pullout from the inside of the packaging material, the tube being able to provide a sufficient damping or cushion function for a multitude of packaging goods by the stiffness of the paper material and the inner-sided hollow space. The packaging material can nearly be ripped off stabilized, for example imprinted, or without stabilization.

The paper strip wound up to a roll of the apparatus according to the disclosure for the manual or automatic production of a tube-like packaging material defines a roll longitudinal axis and forms an inner hollow space, starting from which the paper strip can be pulled off for forming the packaging material. A roll can for example be provided, whose axial length is at least half as great as its outer diameter and/or its axial length be twice as great as its outer diameter at maximum. In an exemplary embodiment, the ratio of axial length to outer diameter of the roll can be greater than 0.75, particularly larger than 1, and/or smaller than 1.75, particularly 1.5. The ratio of axial length and outer diameter of the roll can for example be about 1.25. In an exemplary embodiment, the inner diameter of the roll in condition as new is be greater than 1 cm, preferably larger than 5 cm, particularly preferred larger than 10 cm, and/or smaller than 25 cm, preferably smaller than 20 cm particularly preferably smaller than 17.5 cm. An inner diameter of a new roll can for example be about 16 cm.

The apparatus according to an exemplary embodiment of the disclosure for the manual or automatic production of a tube-like packaging material comprises a guiding chute with an opening for ejecting the packaging material from a roll being arranged in ejection position, wherein the guiding chute has an inner contour narrowing in ejection direction towards the opening. The apparatus further comprises a primary seating for at least partially circumferentially gripping a first roll and for holding the first roll in the ejection position.

The primary seating and the guiding chute can for example be formed as thin-walled plastic parts with a thickness of less than 5 mm, as described for the apparatus of DE 20 2012 009 025 U1 for the manual production of a spiral-shaped packaging material, whose entire content matter is included in the present application by reference. According to the disclosure, the apparatus further comprises at least a secondary seating for receiving of at least a second roll for reloading the apparatus. The secondary seating with the second roll is formed movably between a passive position and an active position. In an exemplary embodiment, a movement of the secondary seating is following a similar movement of the second roll being received in that. It shall be clear that the first roll and the second roll can be identical in condition as new or at least being formed essentially equal. The secondary seating can be formed similarly to the primary seating. The secondary seating can be formed at least partly for the circumferential gripping of the second roll and for holding the second roll in a provision position, wherein the provision position can be different from the ejection position. In a passive position of the secondary seating, the second roll is positioned outside the ejection position.

In a passive position of the secondary seating, an ejection of stock material, particularly the paper strip for forming a packaging material starting from the second roll, is not provided. In a passive position, the second roll can be positioned in an axial distance and/or a radial distance relatively to the guiding chute and/or its ejection opening, which is preferably as large as the axial length or the radial width of the first roll, respectively, particularly in a condition as new. In an exemplary embodiment, sufficient space between the guiding chute or its ejection opening and the second roll is provided in the passive position of the secondary seating so that the first roll can be, particularly is, hinged in an ejection position. The second roll can be taken with the secondary seating from a passive position into an active position particularly in that moment in which the first roll in the primary seating is substantially or entirely consumed.

The second roll can be arranged in the ejection position in an active position of the secondary seating. The secondary seating can for example take the position or similar position as the one that the primary seating has taken before. It is possible, that the secondary seating shifts, glides, rotates, slides or such at the position of the primary seating. According to an alternative embodiment of the disclosure, the second roll in the active position of the secondary seating is preferably exclusively movable under the influence of gravity. According to a second alternative of the disclosure, the second roll in an active position of the secondary seating can slide, glide, roll, fall or such into the primary seating with the aid of the rotational force or the own weight.

The apparatus according to an exemplary embodiment of the disclosure is thereby designed in such a way that the second roll is movable from the secondary seating into the primary seating without manual support that the second roll is arranged in the ejection position after the relocation or as a result of the relocation. In an exemplary embodiment, the second roll is moveable from the secondary seating to the primary seating in such a way that by the relocation from the secondary seating into the primary seating without manual help, the second roll takes a position relative to the guiding chute in axial direction in which the orientation of the axis of the second roll and the distance of the foremost front wall of the second roll in ejection direction relatively to the ejection chute and particularly its opening in such a way that the paper strip for forming the packaging material from the inner hollow space of the second roll may be drawable directly after and/or as a result of the relocation (as previously from the first roll). The roll, which is located in the ejection position in which the paper strip can be pulled off the inner hollow space of the roll through the guiding chute for forming the packaging material is for convenience denoted as "first roll", wherein it is clear that the "first roll" can be a (former second) roll being displaced from the secondary seating into the primary seating.

According to an embodiment, the primary seating can have a shell body particularly from plastic particularly with a smaller wall thickness smaller than 5 mm. In an exemplary embodiment, the shell body of the primary seating is dimensioned with an inner diameter which is at least as great as the outer diameter of a roll designated for being loaded into the apparatus. In an exemplary embodiment, the inner diameter of the primary seating measures at least 20 cm, particularly less than 25 cm, particularly preferably at least 30 cm. In an exemplary embodiment, the inner diameter of the primary seating is smaller than 100 cm, preferably smaller than 50 cm, because the rolls with such a large outer diameter are unpractical to handle. A shell body can also have a different form than the half cylindric shape, for example a V-shape cross-section or a polygonal cross-section. It is also thinkable that the primary seating is formed by at least two struts extending in the direction of the injection direction on which rolls can lie. A primary seating can comprise several struts extending in ejection direction or perpendicular to the ejection direction, in order to at least partly grip a packaging material strip roll circumferentially. By that, a seating longitudinal axis can also be realized by a seating formed by rails and/or struts.

According to an embodiment of the apparatus for the manual or automatic production of a tube-like packaging material, the secondary seating is formed to at least partly circumferentially gripping a second roll. The secondary seating can be formed like the primary seating. For example, the secondary seating can have a second shell body. A second shell body can be separate from a second shell body or be formed single-pieced with a first shell body. The secondary seating can alternatively or additionally have additional rails and/or struts and/or a shape different from cylinder shape. In an exemplary embodiment, the secondary seating can have an essentially half-cylindric shaped shell body. The secondary seating, particularly the second shell body, can define a second seating longitudinal axis. The second seating longitudinal axis can be aligned in an active position of the secondary seating correspondingly, particularly flushing, to the roll axis of the second roll and/or be arranged particularly in the active position of the secondary seating correspondingly, particularly flushing, in the seating longitudinal direction of the primary seating, particularly of a shell body of the primary seating. The secondary seating can be formed form complementary to the primary seating. A second shell body can particularly be formed form complementary to the first shell body of the primary seating.

In an exemplary embodiment, the apparatus for the manual or automatic production of a tube-like packaging material comprises a first roll received in the primary seating and/or at least a second roll being arranged in the at least one secondary seating.

According to an exemplary embodiment the secondary seating comprises a magazine that holds at least one second roll. The magazine can for example hold two, three or more second rolls. In an exemplary embodiment, the secondary seating has a magazine that is arranged as tube magazine with two rolls arranged in axial direction behind each other, a box magazine, preferably with a radial direction, particularly the vertical radial direction, having second rolls around next or on top of each other, wherein particularly the second rolls in the box magazine are each arranged in a touching contact extending in the axial direction between two neighbored rolls in the radial direction, a rod magazine, a drum magazine, preferably with several seatings being turnable around a collective rotation center through which a drum rotation axis is extending, or such. It is thinkable that a magazine, particularly a box magazine, a drum magazine or such, are forming the primary seating and at least one secondary seating. In this way a revolution of the magazine for a drum magazine, comprising several seatings, for example six seatings, can take place in such a way that one of the seatings is always arranged behind the guiding chute in the ejection direction, wherein after the consumption of the paper strip roll the emptied seating can be pivoted away from the guiding chute of the ejection opening by a rotation of the drum magazine and another seating being filled with a roll can take the place and the new roll can take the ejection position. It is also thinkable that for example guiding chutes or guiding chute sections or such are arranged at the drum magazine at the single seatings independently from their position, wherein a rotation of the drum magazine can serve to move away an emptied seating ("primary seating") from an ejection position and to provide the ejection position with a new roll provided seating ("secondary seating").

According to an exemplary embodiment of the packaging material production apparatus, the secondary seating for reloading the primary seating is exclusively arranged by the influence of gravity, particularly relatively to a vertical direction, above the primary seating. The arrangement of the secondary seating particularly for reloading a primary seating can also be positioned only partly above the primary seating. According to a special embodiment, the secondary seating including the received rolls can be arranged completely above the primary seating in such a way that the secondary seating and the arranged roll can be arranged completely above the primary seating and a fresh roll eventually arranged in the primary seating. In an exemplary embodiment, the secondary seating can be arranged relatively to the ejection direction behind the primary seating. The secondary seating can for example be arranged above and behind the primary seating in such a way that the second roll from the secondary seating to the primary seating in the ejection direction.

According to an embodiment of the packaging material production apparatus, the secondary seating particularly for reloading the primary seating can be displaced in parallel at least partly laterally, particularly horizontally with regard to the ejection direction, relatively to the primary seating. In an exemplary embodiment, the secondary seating can be arranged neighbored to the primary seating for an at least partly horizontal or essentially horizontal reloading position in the horizontal direction transverse to the ejection direction. A drum magazine can for example be provided with a drum axis being displaced horizontally to the ejection direction and/or the seating longitudinal axis of the primary seating. It is also thinkable that for example a box or rod magazine can have a magazine extension in horizontal direction transverse to the ejection direction and/or the seating longitudinal axis of the primary seating. The second rolls of such a magazine are provided essentially horizontally next to each other. In an exemplary embodiment, a horizontally aligned box or rod magazine includes a push means, like a spring or such, and/or have a preferably slight tilting of 30°, 15°, 10° or 5° at the most relatively to the horizontal direction.

According to an embodiment of the packaging material production apparatus, the ejection opening and/or the ejection direction are tilted downwardly. The downward tilting can particularly be adjustable. It is clear that relatively to a floor surface in which the production apparatus is placed, a perpendicular of the room extending in the vertical direction can be defined as well as two room horizontals, wherein one room horizontal is orientated according to an orientation of the ejection direction and the second horizontal direction can be defined vertically to both, the perpendicular and the first room horizontal. The term downwardly or tilted downwardly is therefore to be understood in such a way that particularly the ejection direction needs to have at least one direction component in the vertical direction downwards, particularly in such a way that the ejection can take place under the influence or the support of the gravity acting on the paper material strip. In an exemplary embodiment, the ejection opening and/or the ejection direction has a tilting angle of at least 10°, at least 30°, or at least 45°. By the choice of the tilting angle the ejection velocity can be increased for example for a manual ejection apparatus. Depending on the arrangement of the apparatus and the ejection opening the tilting angle can be adjustable for a particularly ergonomic taking of the packaging material from the production apparatus. The secondary seating, particularly a reloading section of the secondary seating, can be arranged relatively to the first horizontal direction in a tilting angle, being equal to the tilting angle of the ejection. The secondary seating, particularly a reloading section of the secondary seating, can have a sliding angle relatively to the first horizontal direction being different from the tilting angle of the ejection opening and/or the ejection direction.

According to an embodiment of the apparatus, which is combinable with the previous, the apparatus has a retainer means which can occupy a retainer position, in which the retainer means inhibits the reloading of the apparatus, and that can occupy a passage position, in which the retainer means allows a reloading of the apparatus. In an exemplary embodiment, the retainer means can be realized as movable means, for example as bar, bolt, flap, hatch, or such. The retainer means can particularly be arranged between the primary seating and the secondary seating. In an exemplary embodiment, the retainer means is arranged in ejection direction between the secondary seating and the primary seating. In an exemplary embodiment, the retainer means in the retainer position is inhibiting the reloading of the primary seating and that the retainer means and the passage position allows the reloading of the primary seating by the second roll. With the retainer means it can be assured that a reloading of the apparatus, particularly the primary seating, by means of a second roll is avoided as long as the paper from the first roll for the production of packaging material is drawable. The retainer means ensures in other words that a second roll is not sliding into the for example primary seating which is still occupied by a partly consumed first roll that could lead to a paper jam. A retainer means can for example for a rod magazine, a flap or trap door be between the secondary seating and the primary seating, or a latch that is inhibiting a drum magazine from a rotation of the second roll in the ejection position. If the magazine of a kind of a tube magazine has rolls being aligned behind each other in axial direction, a retainer means can be formed for example by a latch, wedge, bar or such, which is arranged in the retainer position in the ejection direction between the secondary seating and the primary seating, and which in its passage position allows a gliding or sliding of the second roll into the primary seating in its passage position.

According to an embodiment of the apparatus for the manual or automatic production of a tube-like packaging material, the secondary seating has a reloading section, which is aligned relatively to the primary seating constant particularly operation conformingly immobile and elevated relatively to a primary seating and/or adjacent, particularly flushing, towards the primary seating and/or above the primary seating. In an exemplary embodiment, the secondary seating has a rear filling section in ejection direction A extending in the vertical direction downwards. In an exemplary embodiment, the filling section of the secondary seating extends until below the primary seating, preferably until below the front sided ejection opening of the primary seating. In an exemplary embodiment, the filling section of the secondary seating extends in the vertical direction from a lowest point below the ejection opening toward the highest point close or corresponding to the highest point of a front sided reloading section of the secondary seating. A bridge, curve or saddle-shaped transition area can be provided in the horizontal direction between the filling section and the reloading section. The reloading section of the secondary seating can for example lead to a primary seating in the ejection direction tilted downwards in order to allow a movement of the second roll of the primary seating. The filling section of the secondary seating can be tilted upwards against the ejection direction in order to allow a filling of the rear side of the apparatus. By shifting a roll in the direction of the ejection direction within the filling section, a roll can be fed into the reloading section of the secondary seating. The transition area between the filling area and the reloading area of the secondary seating provides a protection against injuries of the paper strip roll when trespassing from the upwardly tilted filling section into the downwardly tilted reloading section.

According to an embodiment of the apparatus for the manual or automatic production of a tube-like packaging material, the secondary seating is movable in such a way that the secondary seating is movable between an active reloading position for reloading the apparatus, particularly the primary seating, and a passive filling position for refilling at least one further roll in the secondary seating. In an exemplary embodiment, the secondary seating moves into an active reloading position for reloading, particularly of the primary seating, being elevated and/or being positioned upstream, adjacent or overlapping to the primary seating in the ejection direction. The passive filling position can particularly be provided to allow the refilling of a further roll or several further rolls into the secondary seating from a position in the ejection direction behind the apparatus. In this way, the filling staff is enabled to refill, while the packing staff is generating packaging material from the first roll held in the primary seating, the secondary seating so that the secondary seating can be supplied with a second roll before the entire paper material is removed from the first roll. In an active reloading position, the secondary seating is arranged in a position being elevated and/or being positioned upstream in the ejection direction, in a position being adjacent to the primary seating or being overlapping an axial direction to the primary seating. The passive filling position is displaced towards an active reloading position. In an exemplary embodiment, the passive filling position is lowered and/or displaced against the ejection direction towards the rear, particularly relatively to the primary seating. It shall be clear that the relative position denotation of the passive filling position of the active reloading station is mutually relating to one another. In an exemplary embodiment, the active reloading position is positioned upstream relatively to the passive filling position in the ejection direction and/or elevated in the vertical direction. The passive filling position is lowered relatively to the active reloading station in the vertical direction and/or displaced rearwards against the ejection direction. By that, the primary seating can serve as a reference point.

According to a further development, the apparatus for the automatic or manual production of a tube-like packaging material has a secondary seating being translationally, particularly telescopically, movable in or against the ejection direction. Alternatively, or additionally, the secondary seating can be pivotable around a transverse axis, extending transverse to the ejection direction in the horizontal direction (of a second horizontal direction). A first horizontal direction can be oriented correspondingly in the ejection direction. The primary seating and the secondary seating can be coordinated to each other in such a way, particularly dimensioned and/or aligned in such a way, that the secondary seating can move at least section-wise forwards and backwards within the primary seating, preferably telescopically. The secondary seating can be provided with a support apparatus, like a spring, preferably an air pressure spring, for the mass balance regarding the secondary seating. The support apparatus of the secondary seating preferably during a movement of the secondary seating in the vertical direction upwards, for example from its passive filling position in its active reloading position, particularly during a pivoting movement around the transverse axis, can at least in parts be a mass balance of the secondary seating and of the second roll(s) received in it.

According to an exemplary embodiment of the apparatus for the automatic or manual production of packaging material, the apparatus can have at least one sensor for capturing the presence or non-presence of a roll in the primary seating and/or the secondary seating. In an exemplary embodiment, only one sensor for capturing the presence or non-presence of a roll in the secondary seating is provided. The sensor for capturing the presence or non-presence of the roll particularly in the secondary seating can be coupled to the retainer means. With a sensor it can be tested whether at least one roll or at least two rolls are present in the primary seating and/or in the secondary seating, so that the apparatus, particularly the secondary seating, can be refilled before the entire paper strip material, particularly from the primary seating is converted into packaging material, the apparatus therefore being emptied completely.

According to an exemplary embodiment of the apparatus for the manual production of a spiral tube-shaped packaging material according to the disclosure, the apparatus is free from a drive, like an electric drive, for feeding the packaging material and/or the paper strip. According to this embodiment, the apparatus is free of motor, like an electro-motor, driven feed means, like feed rollers. The apparatus of this embodiment is furthermore free of particularly motor, like electro-motor, driven separating means, like a cutting apparatus, for example scissors, a guillotine or such.

According to an exemplary embodiment of the apparatus for the automatic production of a packaging material, the apparatus comprises feed means, like feed and/or forming rollers, for feeding the packaging materials and/or the paper strip as well as a particularly electric drive for driving these feed means. The apparatus according to this embodiment can have if applicable an electric driven separating means, like a cutting apparatus, for example scissors, a guillotine, a rotation cutter or such, for cutting off a cushion material unit, like a cushion product, from the tube-like packaging material.

The disclosure also relates to a packing station with an apparatus for the manual or automatic production of a tube-like packaging material is described in the above embodiments or further developments. The packing station further comprises a frame on which the apparatus is mounted. In an exemplary embodiment, the frame has a front side facing the packing staff, with a shelf space, wherein the opening of the apparatus is arranged at the front side of the frame particularly above the shelf space. Additionally, or alternatively, the frame can have a rear side to be averted the packing staff, wherein the secondary seating is arranged in a preferably tilted and/or backwardly displaced filling state to the rear side, preferably behind the rear side and/or downwards, preferably at or under the frame top side on which preferably the apparatus can be fixed. The frame can for example be mounted to a wall, be mounted hanging from the ceiling, or be arranged standing on the ground. Combinations of the mounting of the frame or of frame components, respectively, in a room are thinkable.

In the following depictions of exemplary embodiments same or similar reference numerals are employed for the same or similar components. An apparatus according to an exemplary embodiment of the disclosure for the manual or automatic production of a tube-like packaging material is in general denoted with reference numeral 1. A packing station is denoted with reference numeral 100 in the following. For simplicity reasons, the depiction of embodiments of detailed motors or motor-driven feed or forming rollers or such Figures are left out. It is hereby referenced to DE 10 2009 015 855 A1, EP 2 711 167 A1, EP 2 711 168 A1 and DE 10 2005 053 319 A1, whose entire content shall be included into the application by reference. The apparatus 1 according to the disclosure for the manual or automatic production of a tube-like packaging material from a paper strip coiled to a roll 11, 12 comprises as main components a guiding tube 5, a primary seating 3 positioned behind in the ejection direction, and a secondary seating arranged above and/or behind that. As laid out in the depictions of embodiments in detail, the secondary seating can for example be realized as a part of a magazine, for example a tube magazine 20 extending lengthwise with rolls arranged behind each other, as box magazine 40 with rolls stacked on top of each other or as drum magazine 30 with rolls supported around a drum axis T turnable in the separate seatings.

In the following, the packing station 100 with a manual packaging material production apparatus 1 having a tube magazine 20 is described in FIG. 1. The packaging material production apparatus 1 is mounted on a frame 101. The frame 101 is standing on the floor of the logistic center (not depicted in detail) of the kind of a shelf. Starting from the room, in which the apparatus is located, particularly the floor, on which it stands, a vertical direction, as well as two horizontal directions H1, H2 extending transverse to each other and transverse to the vertical direction V can be defined.

The first horizontal direction shall be oriented according to the ejection direction A of the apparatus 1. The ejection direction A is set by the form and arrangement of the ejection opening 7, which is provided in the center of the ejection and guiding chute 5 of the apparatus 1. The ejection direction A is tilted downwards by a tilting angle $\alpha$ against a first horizontal direction H1. The primary seating 3, which is formed in the exemplary embodiment examples by a half cylindric shell body 53, in which a first roll is supported, extends in the ejection direction A behind the ejection and guiding chute 5.

The seating longitudinal axis L1 of the primary seating corresponds to the first roll longitudinal axis L1 of the first roll 11. It shall be clear that slight radial displacement between the roll longitudinal axis L1 and the seating longitudinal axis L1 is possible in the range of possible tolerances in the radial direction to the longitudinal axis. In an exemplary embodiment, the first roll 11 abuts with its frontal front side at the inner, chute-shaped wall of the guiding chute 5, preferably with a radial circumference outer side of the roll 11.

The paper strip forming the rolls 11 can be stripped from the inner side of the roll 11 through the guiding chute 5 and its ejection opening 7, wherein the spiral tube-shaped packaging material is formed, which can be ripped off the ejection opening 7 for forming a single packaging material unit. The shell body 53 and the guiding chute 5 can be made thin-walled particularly from plastics. The guiding chute 5 can be mounted with a plug connection, like a bayonet connection, detachable or not detachable at a first shell body 53.

A secondary seating 21, which is also realized here as a shell body 23, is provided in the ejection direction A behind the first shell body 53 of the primary seating 3. The second shell body 23 of the embodiment shown in FIG. 1 also has a thin wall with a wall thickness of less than 5 mm, which can be made of the same material as the first shell body, for example from plastics. The shape of the first shell body 53 and the second shell body 23 are dimensioned correspondingly, they in particular have the same inner diameter and/or the same wall thickness. Exemplarily, the shell bodies 23, 53 are depicted half cylindric. They can also have a different form, for example a polygonal or V-shape.

In an exemplary embodiment, the second shell body 23 has a slightly smaller inner diameter than the first shell body 53. The inner diameter of the second shell body 23 can for example measure by one wall thickness or more, less than an inner diameter of the front, first shell body so that the second shell body 23 can be arranged at least partly inside the first shell body and can be displaceable translationally, and in an exemplary embodiment, telescopically, within the first shell body 53 (not depicted in detail). A bar 61 or a retainer means can be provided between the primary seating 3 provided by the first shell body 53 and the secondary seating 21 provided by the second shell body 23, which inhibits a second roll in the primary seating 21 to shift unhinderedly into the ejection position at the primary seating. The retainer means 61 is realized as bar in FIG. 1, which is pivotable upwards for arriving at a passage position not depicted in detail here on which the retainer means 61 is releasing an unhindered passing or shifting of a second roll (not depicted in detail) from the secondary seating 21 in the direction of the ejection direction A towards the guiding chute 5.

The secondary seating 21 is arranged in ejection direction A behind and in vertical direction V above the primary seating 3 so that a not further depicted second roll from the secondary seating 21 can glide under the major influence of gravity from the secondary seating 21 into the primary seating 3. In order to allow a simple gliding or sliding of a roll from the secondary seating 21 into the primary seating 3, the seating longitudinal axis L2 of the secondary seating 21 and L1 of the primary seating 3 can be arranged correspondingly, particularly flushing, to each other. The apparatus 1 can for example have a for example capacitive sensor 70 at the secondary seating 21, which captures a roll is located in the secondary seating 21. If, as in FIG. 1, no roll is arranged in the secondary seating 21, the sensor can capture this and address this to control electronics. These control electronics can then signalize, for example, by an optical signaling apparatus, like a light 71, whether or not the production apparatus 1 has to be refilled. The light 71 can for example light in green, if both the primary seating 3 and the secondary seating 21, are each filled with a roll 11, 12 (not depicted in detail). The light 71 can signal with a different signal, for example with a yellow lighting, that a roll 11 is still present in the production apparatus 1, from which a paper strip for the forming of a packaging material is strippable, but no second roll, no second rolls, or not the full number of second rolls, which the magazine is able to receive, is arranged in the secondary seating 21. The lights can indicate with a third, for example red, light signal, if no roll at all is arranged in the production apparatus 1 anymore. In an exemplary embodiment, the sensor includes processor circuitry that is configured to perform one or more functions and/or operations of the sensor.

Alternatively, or additionally, also different signals can be generated, for example an acoustic signal and/or a signal to a central control unit, which for example can be informed about the consumption of paper material strip rolls of a single or each single production apparatus within a logistic center. The (not further depicted) control electronics can be connected to retainer means 61 where a further (not further depicted) sensor can be provided in order to capture the reloading procedures of the apparatus. If the apparatus, as for the embodiments explained later, has a magazine 30, 40 with a capacity for more than one second roll 12, by the use of one or more sensor 70, at one or more secondary seatings and/or a reloading sensor, for example a retainer means, can be monitored, if or how many rolls are available in the production apparatus. In an exemplary embodiment, the central control unit and/or the control electronics include processor circuitry that is configured to perform one or more functions and/or operations of the central control unit and/or the control electronics.

FIGS. 2A, 2B, 2C and 2D show an apparatus 1 for the production of the packaging material which essentially comply with the production apparatus 1 shown above in FIG. 1. The depiction of the FIGS. 2A to 2D deviate from the depiction in FIG. 1 essentially only by the air pressure spring 63 supporting the secondary seating 21 and in that the FIGS. 2A to 2D do not show the sensor 70 and the light 71. It is clear to one skilled in the art that he only needs to arbitrarily add the components (sensor 70 and light 71) shown in FIG. 1 and the components only shown in the FIGS. 2A to 2D (air pressure spring 63) to the respective other embodiment. By that, the depiction of the production apparatus 1 of FIG. 2A essentially complies with the one according to FIG. 1. The production apparatus 1 is held by a first holding apparatus 60 with a fixture 64 and a second fixture 66, which are supporting themselves on a frame 101. It shall be clear that a single fixture 64 (as in FIG. 1) can carry the entire production apparatus 1. The front, first fixture 64 is arranged approximately centered underneath the first shell body 53 in the primary seating 3. The primary seating 3 is mounted to the fixture 64 by a pivoting hinge which can be grounded in several different tilting positions. By that, the tilting angle $\alpha$ of the ejection direction A relatively to the horizontal direction H1 is set. A first supporting beam 65 extends underneath the shell body 53 of the primary seating 3, the supporting beam carrying the fixture 64. The supporting beam extends against the ejection direction A backwards and ends in the area of the rear end of the primary seating 3.

A second supporting beam 67 extends underneath the shell body 23 of the secondary seating 21. The second supporting beam 67 extends mainly in the direction of the support longitudinal axis L2 of the secondary seating 21. The second supporting beam 67 supports itself at the second fixture 66 being mounted at the top side 109 of the frame 101. Instead of a fixture consisting of two fixtures 64, 66, also a single fixture can be provided. The in the ejection direction A front-sided end of the second supporting beam 67 is supported at the first supporting beam 65 via a hinge 68. The hinge 68 connecting the primary seating 3 with the secondary seating 2 allows a translatory movement of the secondary seating 21 relatively to the primary seating 3 in the direction of the first seating longitudinal axis L1. The hinge 68 between the primary seating 3 and the secondary seating 21 also allows a pivoting movement of the secondary seating 21 around a transverse axis Q relatively to the primary seating 3.

As shown in FIGS. 2B, 2C, the secondary seating 21 can be displaced relatively to the primary seating 3 translationally backwards and can be pivoted downwards around a transverse axis Q in order to take a filling position for refilling the apparatus 1 with further rolls. In this filling position, the shell body 23 of the secondary seating 221 is approximated at the top side of the frame 101 so that a refilling axis from the rear side 105 of the frame is easily possible by the refilling staff.

A roll 12 just filled being introduced from the rear side 105 into the secondary seating 21 is shown in FIG. 2C. When the secondary seating 21 is pivoted upwards around the transverse axis Q and the secondary seating is approached translationally to the primary seating 3, the second roll 12 slides into the secondary seating 21 in the ejection direction A to the front side. For the relocation in the vertical direction V upwards, the secondary seating 21 is lifted with the second roll 12 arranged in it. The pressure spring 63 is provided in order to provide a weight relief when lifting the secondary seating 21 with the second roll 12 arranged in it.

In an exemplary embodiment of an apparatus for the manual or automatic production of packaging material is shown in FIGS. 3A to 3D. FIGS. 3A to 3D deviate from the embodiment described before in the first place in that the secondary seating 31 is realized as part of a drum magazine 30. The drum magazine 30 comprises four secondary seatings 31 with hollow cylindric shell bodies 33. The four hollow cylindric shell bodies 33 are turnable around a joint drum axis T supported in a cylindric magazine drum 32. The shell bodies 33 are formed full-cylindrically so that the rolls 12 contained in them are not falling off the secondary seating 31 during the rotation around the drum axis T.

The drum axis T is in the reloading position, shown in FIGS. 3A and 3C, parallel to the first support longitudinal axis L1 of the primary seating 3. In an exemplary embodiment, the drum axis T is provided coaxially with the essentially same radial distance to the single secondary seatings 31 centrally between them. In an exemplary embodiment, the distance of the second seating longitudinal axis L2 is greater than the diameter of the full shell body 33 and smaller than double of the shell body diameters. In an exemplary embodiment, the distance between the drum axis and the second longitudinal seating axis L2 is equally great. The distance of the drum axis T to the second longitudinal seating axis L2 can be greater than the diameter of the shell body 33. In an exemplary embodiment, the distance from the second longitudinal support axis to the drum axis is at the least of the 1.4-fold and/or at the most the 1.6-fold, preferably about 1.5-fold of the diameter of a support shell 33. The magazine drum 32 is held with a movable holding apparatus, similar to the ones described in FIGS. 2A to 2D, at the frame 101 of the packing station 100. The fixture can have a first fixture 64 and a first supporting beam 65, as described above, for carrying the primary seating. The holding apparatus can further have a second fixture 66 on which a second supporting beam 67 is supporting itself by one or more springs, particularly compressed air springs 65. The supporting beam 67 can further be held at the first supporting beam 65 via a hinge 68. With the articulated arrangement of the second supporting beam pivotable around the hinge 68 and supported by the compressed air spring 63, the entire drum magazine 30 can be lowered and lifted as well as be pivoted between a rear-sided filling position and a front-sided refilling position shown in FIGS. 3A and 3C.

As shown in FIG. 3B, the drum magazine 30 can rotate around the drum axis T in order to remove a for example emptied secondary seating from the primary seating 3 and to bring a second secondary seating 31 stocked with a second roll 12 into the reloading position.

During the reloading procedure according to FIG. 3C, a retainer means, like a bar 61 can be brought between the primary seating 3 and the secondary seating 31 in a passive passage position so that the second roll 12 can slide from the secondary seating 31 arranged in reloading position into the primary seating 3. FIG. 3D shows a primary seating with a freshly-reloaded first roll 11. The drum magazine 30 can turn after the reloading of the primary seating 3 from the secondary seating 31. The secondary seating 31 with its entire drum magazine 30 around the drum axis T, as indicated in FIG. 3B so that a different, stocked secondary seating arrives in a refilling position. An independent (roll) turning is prevented by a not further depicted retainer means. The embodiments shown in FIGS. 2A to 2D or 2A to 3D, respectively, deviate from the embodiment shown in FIGS. 4A to 4E essentially in that the secondary seating 41 is part of a box magazine 40. The box magazine 40 can be mounted to the frame 101 via a fixture according to the one described above. Within the box magazine for example four second rolls 12 can be arranged, which directly lie above each other in the vertical direction 4.

It is alternatively also thinkable to use a rod magazine on which rolls are arranged to each other not automatically perpendicular in the vertical direction, but in the vertical direction above each other, however not perpendicular but displaced in a zigzag manner. In this way, more rolls can be accommodated in a rod magazine than in a box magazine 40 with the same height in the vertical direction V, for the same vertical height but greater width in the horizontal direction H2.

As shown in FIGS. 4B and 4C, a roll 12 can be displaced from the box magazine 40 frontwards in the ejection direction from the secondary seating 41 into the primary seating 3 after emptying the primary seating 3. If the roll displaced by that takes the place of the first roll 11 in the primary seating 3, as shown in FIG. 4C, one second roll 12 less than before is positioned in the box magazine 40, in this case for example only three second rolls 12 (cf. FIG. 4C). The state is also shown in FIG. 4D, however, with a view to the rear side 105 of the frame 101 of the packing station 100.

By means of the holding fixture 60, the box magazine can be brought from the active reloading position (4D) into a filling position pivoted backwards for example by 90° around the transverse axis Q of the hinge 68 of the holding fixture 60 (FIG. 4E). In the filling position, the filling staff can introduce second rolls in the box magazine 40 from the rear side 105 of the frame until it is filled with rolls 12 again. Subsequently, the box magazine can be lifted backwards into the active reloading position (FIG. 4D) in that the filling staff lifts the box magazine 40 supported by the compressed air spring(s) of the holding fixture 60.

Deviating from the previous embodiments, the apparatus 1 for the production of a packaging material according to the FIGS. 4A to 4E in the reloading position the seating longitudinal axis L2 of the lowest shell body 43 of the secondary seating 41 is oriented in the first horizontal direction H1 according to the first seating longitudinal axis L1 of the primary seating 3, however the first and the second seating longitudinal axis L1, L2 are not flushing. Rather, an angular displacement between the essentially horizontal direction, particularly the first horizontal direction H1, of the second seating longitudinal axis L2 and their first seating longitudinal axis L1 tilted by the tilting angle $\alpha$ is present. In an exemplary embodiment, the angular displacement corresponds to the tilting angle $\alpha$.

The exemplary embodiments in FIGS. 5A to 5H are essentially based on the embodiment shown in FIG. 1 so that the description contents laid out above in FIG. 1A are entirely transferrable to the embodiment according to FIGS. 5A to 5H. The apparatus for the production of packaging material according to FIGS. 5A to 5H has a kind of a tube magazine 20 that is able to receive more than two, for example four, five or more second rolls 12 additionally to the first roll 11 in the primary seating 3. The secondary seating 31 comprises a in the ejection direction A front-sided reloading section 22 and a in the ejection direction A rear-sided refilling section 24. The reloading section 22 forms the secondary seating 21. In the reloading position 22, several, for example two, second rolls 12 can be arranged axially behind each other, and in exemplar embodiment, flushing. The reloading section 22 defines a seating longitudinal axis L2 with a sliding angle $\beta$, which is tilted downwards relatively to the first horizontal direction H1. As shown in FIG. 5B, 5E or 5G, the sliding angle β can comply with the tilting angle α. As conceivable in FIG. 5A, the tilting angle α of the ejection can be adjusted independently from the sliding angle β. The tilting angle α can for example have a position between 0° and 90°. The rear-sided end of the primary seating 3 is thereby located in the vertical direction V at the most at the same vertical height as the secondary seating 21 so that a reloading of the primary seating 3 with a roll from the secondary seating 21 can take place independently from the difference between the sliding angle β and the tilting angle α. The tilting angle α can be adjusted with the help of the fixture 64 of the primary seating 3. In an exemplary embodiment, the reloading section 22 tilted downwards with the tilting angle β is possibly being kept filled with second rolls 12. It could thereby be relevant whether one or more rolls are present in the filling section 24. The filling section 24 can operation-accordingly also be free of rolls. In this case, a new roll would be introduced into the filling section 24 only during filling of the reloading section 22 and being shifted in the vertical direction upwards until the roll transits from the filling section 24 into the reloading section 22 by means of the transverse section.

For this purpose, a sensor (not depicted), like the sensor 70 described above, can be provided in the rear-sided area of the secondary seating 21, for example in the area of the rear-sided shell body 23B, in order to notice a presence or non-presence of a second paper roll 12 at this position. A sensor like the sensor 70 described above could generate a paper roll need signal at the rear-sided end of the reloading section 22 for processing by the control electronics, for example by generating a need signal by means of the lights 71.

The holding fixture 60 of an exemplary embodiment of an apparatus 1 shown in FIGS. 5A to 5H deviates from the holding fixture 60 described above in that the positions of the secondary seating 21 or the entire magazine 20, respectively, are adjusted operation-accordingly position-fixed. The refill ability of the secondary seating 21 during the usage of the apparatus 1 for the production of packaging paper by packing staff at the frontside 103 of the frame 101 is assured in this embodiment in that a filling section 24 of the secondary seating 21 is provided at the rear side 105 of the frame 101 being tilted downwards from the reloading section 22 in the vertical direction. The filling section 24 can have a shell body 25 formed of a kind of a slide which can receive one or more second rolls 12. With respect to the general shaping of the shell body 25 in the filling section 24 of the apparatus 1 according to the FIGS. 5A to 5H, the same applies with regard to the scope of design of the shell body 23, 53 etc. mentioned above.

In an exemplary embodiment, the filling section 24 extends until behind the rear side 105 of the frame 101 until underneath the ejection opening 7 and/or the top side 107 of the frame 101 of the packing station 100. In an exemplary embodiment, at the rear-sided, lower filling end of the filling section 24, a holder is formed as an edge 26 and/or flap which prevents a slip out of new second rolls 12 from the filling section. Securing clamps 27 or other securing means can be provided in the filling section 24, which are provided in the vertical extension of the filling section 24 at least section-wise in order to prevent a rearward tilting out of one or more rolls from the filling section 24. Securing clamps 27 can for example be provided to each other at the clamp section in distances smaller than the axial length of a roll 12.

For filling the apparatus 1, filling staff can introduce or insert, respectively, fresh rolls into the filling section 24 from the rear side 105 of the frame 101. One or more rolls can be put from a lower filling position upwards to the refilling section 22, manually, by means of tools or motor-driven feed means, for example a conveyor, or such.

It can be seen from FIG. 5B that the secondary seating is composed and the reloading section 22 of several telescoped shell bodies 23*a* and 23*b*. A transfer section 28 forming a curve-shaped transition from the upwardly-tilted shell body 25 of the filling section 24 and an angle β of the shell bodies 23 (23*a*, 23*b*) of the reloading section 22, is provided between the rear-sided shell body section 23*b* and the shell body 25, which is realizing the filling section 24.

The telescopic ability of the shell body sections 23*a*, 23*b* allows, dependent on the width of the frame 101, to statically adjust the axial length of the secondary seating 21. In an exemplary embodiment, the rear-sided shell body 23*b* is introduced section-wise into the front-sided shell body 23*a*. For this purpose, the front-sided shell body 23*a* and the rear-sided shell body 23*b* have the same cross-sectional shape with different cross-sectional width, for example a half-cylindric or V-shaped cross-section shape with different vastness (inner diameters). An alternative embodiment of two or more longitudinal struts forming the secondary seating can be designed in such a way that struts with the same length extension direction (L2) being displaced in the axial direction and in the radial direction to each other are provided so that overlapping areas between the front-sided and rear-sided struts comply with the overlapping area of both of the shell bodies 23*a*, 23*b*.

It is also thinkable that the front-sided area of the one or several shell bodies 23 of the reloading section 22 overlaps with the rear-sided area of the shell body 53 of the primary seating 3 in the axial direction.

In an exemplary embodiment, in order to avoid a locking of the rolls 11, 12 at the transition between different seating sections, a flushing arrangement of the different sections to each other is used, or an arrangement on which seating sections being arranged further rear-sided in the ejection direction A are extending section-wise within a seating section lying before in the ejection direction. The rear-sided shell body section 23*b* of the embodiment shown in FIG. 5B extends for example in its front-sided half within the front-sided shell body 23.

FIGS. 5E and 5F show a retainer apparatus of the shape of a bar 62 in its retainer position. In FIGS. 5G and 5H, the bar 62 is shown in passing position. The bar 62 extends in the ejection direction A at the front-sided end of the secondary seating 21 through its shell body 23 in the radial direction until to the area of the seating of the second roll 12. The roll 12 is arranged in the ejection direction A behind the bar 62 so that the bar prevents the roll 12 from sliding in the ejection direction A forwards into the primary seating 3 as long as the same is in the retainer position.

By activating a lever 72, the bar 62 can be driven in the radial direction outwardly until a passing position in which the same is located outside the roll area of the secondary seating 21, so that it is not a barrier for the roll 12 anymore. The bar 62 can for example be moved by a mechanical activation, such as a lever 72, mechanically from the retainer position into the passing position and when releasing the lever 72, the spring returns pre-loaded into the retainer position. It is also possible that instead of a manual, a mechanical activation takes place by a (not further depicted) control button or a controlled electric activation, by which an electronic actuator of the retainer means, such as a bar 62 or the previously-described bar 61, is moved between the retainer position. An electronic activation by means of a reloading button can, at the same time, be connected to the control electronics and the button press can be evaluated as a signal for the order of a further roll for filling the secondary seating.

The features disclosed in the preceding description, the Figures and the claims can be of importance for the realization of the disclosure in different embodiments in both, singular and in arbitrary combinations.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 production apparatus
3 primary seating
5 guiding chute
7 ejection opening
11, 12 roll
20 tube magazine
21,31,41 secondary seating
22 reloading section
23*a*,23*b* shell body section
23,33,43 second shell body
24 filling section
25 shell body
26 edge
27 securing clamp
28 transition area
30 drum magazine
32 magazine drum
40 box magazine
51 inner contour
53 first shell body
60 holding fixture/apparatus
61 bow
63 compressed air spring
64 first holder
65 first supporting beam
66 second holder
67 second supporting beam
68 hinge
70 sensor
71 lights
72 lever
100 packaging station
101 frame
103 front side
105 rear side
107 top side
A ejection direction
H1, H2 horizontal direction
L1, L2 seating longitudinal axis
Q transverse axis
R1, R2 roll longitudinal axis
T drum axis
V vertical direction
α tilting angle
β sliding angle

The invention claimed is:

1. An apparatus for manual or automatic production of a tube-like packaging material from a paper strip wound up to a roll, the paper strip defining a roll longitudinal axis and forming an inner hollow space, from which the paper strip is drawable for forming the packaging material, the apparatus comprising:

a guiding chute including:

an opening in which packaging material is ejectable from a first roll arranged in an ejection position, an inner contour narrowing in an ejection direction towards the opening;

a primary seating configured to at least partly circumferentially grip the first roll and to hold the first roll in the ejection position; and at least one secondary seating configured to receive a second roll to reload the apparatus, the secondary seating with the second roll being movable, with respect to the primary seating, between a passive position, in which the second roll is outside the ejection position, and an active position, in which the second roll is shiftable from the secondary seating into the primary seating.

2. The apparatus according to claim 1, wherein the secondary seating comprises a magazine configured to contain the second roll.

3. The apparatus according to claim 2, wherein the magazine is a tube magazine, box magazine, rod magazine, or drum magazine configured to contain the second roll.

4. The apparatus according to claim 1, wherein the secondary seating is arranged above the primary seating and behind the primary seating with respect to the ejection direction such that, when in the active position, the second roll is shiftable into the primary seating due to gravity to reload the primary seating with the second roll.

5. The apparatus according to claim 1, wherein the secondary seating is arranged relatively to the primary seating to reload the primary seating displaced at least partly sideways such that the primary seating is displaced parallel horizontally with respect to the ejection direction.

6. The apparatus according to claim 1, wherein the ejection opening or the ejection direction is adjustably tiltable.

7. The apparatus according to claim 1, wherein the apparatus comprises, between the primary seating and the secondary seating, an arranged and movable retainer configured to: inhibit the reloading of the primary seating of the apparatus when located in a retaining position, and allow the reloading of the primary seating of the apparatus with the second roll when in a passing position.

8. The apparatus according to claim 7, wherein the retainer is a bar, a bolt, a flap, or a hatch.

9. The Apparatus according to claim 1, wherein the secondary seating is configured to be movable relative to the primary seating such that the secondary seating is movable between: an active reloading position for reloading of the primary seating elevated and/or arranged upstream, adjacent or overlapping to the primary seating in the ejection direction, and a passive filling position for refilling at least one further roll of the one or more rolls into the secondary seating from a position in the ejection direction behind the apparatus below and/or displaced backwards relative to the primary seating in ejection direction.

10. The apparatus according to claim 9, wherein the secondary seating is movable translationally in or against the ejection direction or that the secondary seating is pivotable around a transverse axis that extends transversely to the ejection direction in a horizontal direction, wherein the secondary seating comprising a biasing member that is configured to mass balance the secondary seating.

11. The apparatus according to claim 1, further comprising at least one sensor configured to detect a presence or non-presence of a roll of the one or more rolls in the primary seating or the secondary seating.

12. The apparatus according to claim 1, wherein, for a manual production of a spiral tube-shaped packaging material, the apparatus is free of: a drive configured to feed the packaging material and/or the paper strip, a motor, feed rollers, and cutter.

13. The apparatus according to claim 1, further comprising, for automatic production of a packaging material: feed and/or forming rollers configured to feed the packaging material and/or the paper strip, an electric drive configured to operate the feed and/or forming rollers, and an electric cutter configured to separate a cushion product from the tube-like packaging material.

14. The apparatus according to claim 1, wherein the second roll is shiftable from the secondary seating into the primary seating due to gravity.

15. The apparatus according to claim 1, wherein the second roll is shiftable from the secondary seating into the primary seating due to gravity.

16. The apparatus according to claim 1, wherein in the passive position prevents the second roll from being shifted into the primary seating.

17. The apparatus according to claim 1, wherein:

the second seating is tiltable with respect to the primary seating;

in the active position, the primary seating and the secondary seating are orientated parallel to the ejection direction; and in the passive position, the primary seating is orientated parallel to the ejection direction and the secondary seating is angularly offset from the ejection direction.

18. A packing station comprising:

the apparatus according to claim 1; and a frame on which the apparatus is mounted, the frame including:

a front side having a shelf and configured to face an operator of the packing station and at which the opening of the apparatus is positioned above the shelf; and a rear side in which the secondary seating is displaceably arranged in a tilted and/or backwardly displaced filling state to a rear of the frame behind the rear side and/or downwardly at or under a top side of the frame on which the apparatus is mounted.

* * * * *